United States Patent [19]

Lee

[11] Patent Number: 4,979,651

[45] Date of Patent: Dec. 25, 1990

[54] SAFETY VALVE FOR A HIGH PRESSURE SPRAY CONTAINER

[76] Inventor: Jiin C. Lee, No. 138, Ta An Kang, Hai Chien Villiage, Ta An Hsiang, Taichung Hsien, Taiwan

[21] Appl. No.: 361,846

[22] Filed: Jun. 5, 1989

[51] Int. Cl.[5] ..... B65D 83/00

[52] U.S. Cl. ..... 222/377; 251/65; 137/521

[58] Field of Search ..... 222/396, 397, 402.1; 251/65; 137/517, 521, 855, 857

[56] References Cited

U.S. PATENT DOCUMENTS

| | | | |
|---|---|---|---|
| 2,563,200 | 8/1951 | Venning | 137/521 |
| 2,864,394 | 12/1958 | Hempel | 137/521 |
| 3,134,519 | 5/1964 | Tidd | 222/397 |
| 3,357,601 | 12/1967 | Crawford et al. | 222/397 |
| 4,462,424 | 7/1984 | Genbauffe et al. | 222/397 |

*Primary Examiner*—H. Grant Skaggs
*Assistant Examiner*—Kenneth Noland
*Attorney, Agent, or Firm*—Rogers, Howell & Haferkamp

[57] ABSTRACT

A safety valve for a high pressure spray container including a short cylindrical portion with a sealed end. An annular flange with an annular groove is integrally connected to the open end of the cylindrical portion for clamping onto a high pressure spray container. An opening is formed in the cylindrical portion close to the sealed end. A flat spring member is disposed on the outer side of the opening for sealing the opening when the spray container is injected with liquid and pressurized air.

1 Claim, 4 Drawing Sheets

SAFETY VALVE FOR A HIGH PRESSURE SPRAY CONTAINER

FIELD OF THE INVENTION

The present invention relates to a safety valve, and more particularly to a safety valve for a high pressure spray container.

BACKGROUND OF THE INVENTION

As shown in FIG. 4, a conventional high pressure spray container 8A, such as a pesticide sprayer, is generally a container with a nozzle 81A and a tube 82A disposed therein. Liquid or pesticide, which is generally highly vaporizable and flammable, and high pressure air or gas are injected into the container for spraying purposes. A concave (upwards) bottom 83A is usually formed in the spray container 8A so that some liquid remains left within the container 8A after use. This is very dangerous, especially when these kinds of spray containers are inadvertently burned, since explosion may result from this effect.

The present invention has arisen to mitigate and/or obviate the afore-described disadvantages of the conventional pressurized spray containers.

SUMMARY OF THE INVENTION

The primary object of the present invention is to provide a safety valve for a high pressure spray container, which opens the spray container when the pressure within the spray container is low.

The present invention seeks to provide a safety valve for a high pressure spray container including a short cylindrical portion with a sealed end. An annular flange with a groove formed therein is integrally connected to the open end of the cylindrical portion for clamping onto the high pressure spray container. An opening is formed in the cylindrical portion close to the sealed end. A flat spring member is disposed on the outer side of the opening for sealing the opening when the spray container is injected with liquid and pressurized air.

Further objects and advantages of the present invention will become apparent from a careful reading of the detailed description provided hereinbelow, with appropriate reference to the accompanying drawings.

DETAILED DESCRIPTION OF THE INVENTION

Figure 1:
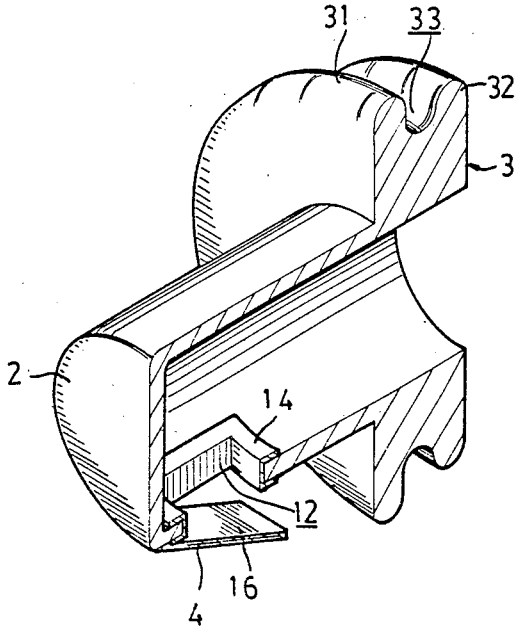
FIG. 1 is a cross-sectional perspective view of a safety valve in accordance with the present invention.
Figure 2:
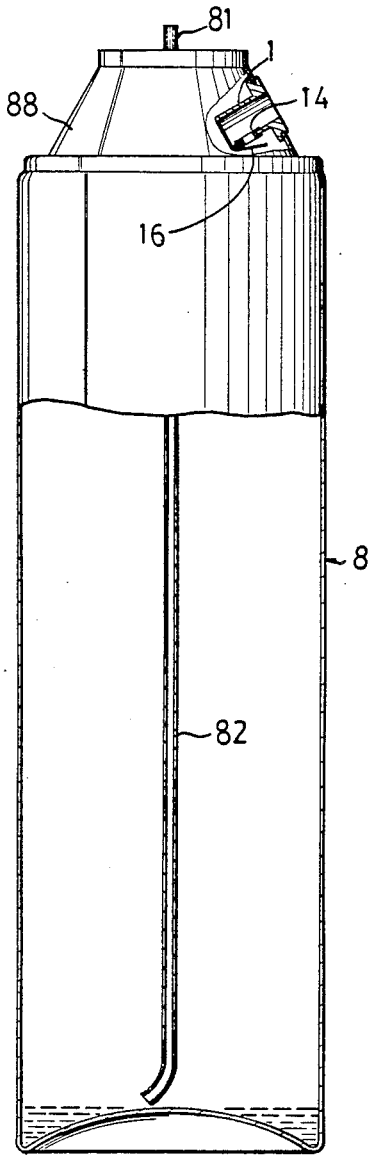
FIG. 2 is a partially cutaway cross-sectional view embodying the present invention.

Referring to FIGS. 1, and 2, a safety valve in accordance with the present invention is generally composed of a short cylindrical portion 1 having a sealed end 2. An annular flange 3 with a groove 33 formed thereon is integrally formed on the open end of the cylindrical portion 1. The flange 3 comprises an inner subflange 31 and an outer subflange 32. The outer diameter of the inner subflange 31 is slightly larger than that of the outer subflange 32. An opening 12 is formed in the cylindrical portion 1 close to the sealed end 2. A packing 14 is provided on the peripheral edges of the opening 12 for sealing purposes. A flat spring member 16, such as a resilient plate, has one end integrally fixed on the lower surface of one edge, generally the edge abutting the sealed end, of the opening 12 (FIG. 2). Under normal condition, the free end of the spring member 16 has a small distance away from the opening 12. A metal plate 4, which can be attracted by a magnet 5 (FIG. 3), is embedded in the spring member 16.

Generally, the safty valve in accordance with the present invention is made of materials such as rubber, plastics etc., which can be melted by heat, such that the flange 3 can be force-fitted, from inside, onto a cap 88 of a high pressure spray container 8.

Figure 3:
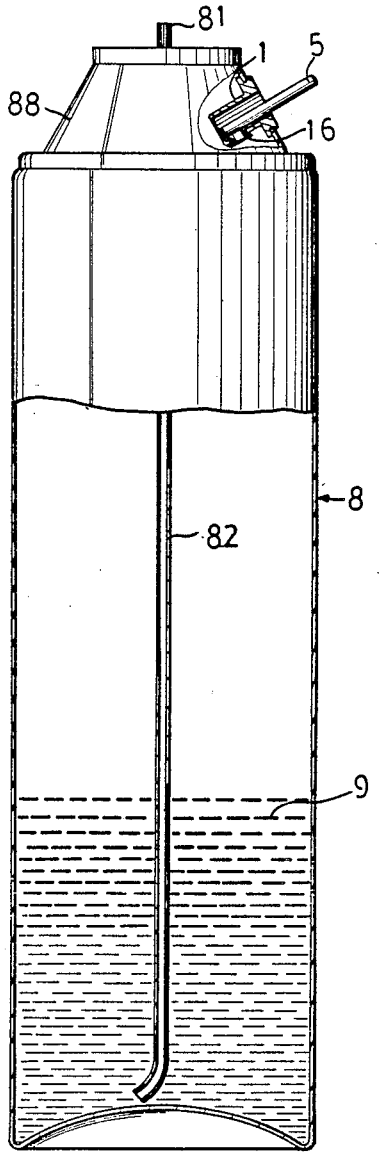
FIG. 3 is a partial cross-sectional view similar to FIG. 2, showing liquid injecting process.
Figure 4:
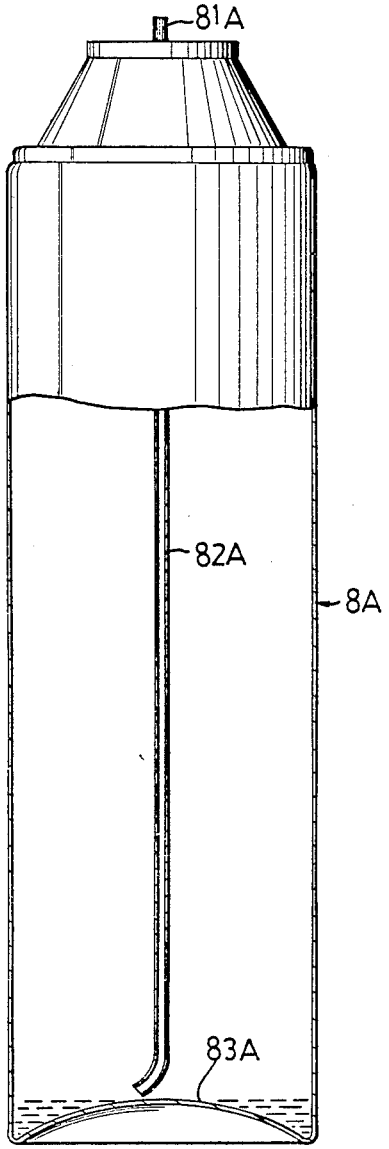
FIG. 4 PRIOR ART
FIG. 4 is a partial cross-sectional view of a conventional high pressure spray container.

Please refer now to FIG. 3, which shows the process of injecting the liquid 9 into the high pressure spray container 8. Before injecting, a magnetic element 5, such as a bar magnet, is inserted into the cylindrical portion 1 for attracting the free end of the spring member 16 to contact with packing 14 in order that the liquid 9 and pressurized air can be injected into the high pressure spray container 8. After injecting a substantial quantity of the liquid 9 and the pressurized air, the spring member 16 is forced by the pressure within the high pressure spray container 8, and makes an airtight sealing for the opening 12. The magnet 5 can be moved at that time. The resilient force of the spring member 16 is predetermined so that the free end of the spring member 16 can spring back when the level of the liquid 9 is lower than the lower end of the tube 82 and the pressure within the spray container 8 is lower than the resilient force of the spring member 16 plus atmospheric pressure. Thus, the liquid and the pressurized air within the high pressure spray container 8 freely vaporize into the atmosphere. Explosions can be avoided when this spray container is burned inadvertently. In addition to the above-mentioned feature, even if the spring member 16 for some reason does not spring open when the liquid within the spray container is nearly depleted, the safety valve itself would melt during incineration due to the heat of the flame to further assure that no pressure build-up and no explosion would occur. Alternatively, the spring member 16 can be forced to close the opening 12 without the magnet element 5 and the metal plate 4 when the liquid and the pressurized gas are injected into the spray container 8 very fast.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A safety valve for a high pressure spray container comprising a cylindrical portion having a sealed end, an annular flange being connected to an open end of said cylindrical portion for fitting onto said high pressure spray container, an opening being formed in said cylindrical portion, and a flat spring member being disposed adjacent to an outer side of said opening, a metal plate being embedded in said flat spring member; said metal plate being displaced to a closed position of said flat spring member by a magnet and thereby held in its closed position by sufficient gas pressure within said container; and said flat spring member being released to an open position when a low pressure within said container is reached so that a remaining gas pressure for said container is discharged.

* * * * *